US011913213B2

(12) United States Patent
Larson

(10) Patent No.: US 11,913,213 B2
(45) **Date of Patent: *Feb. 27, 2024**

(54) MODULAR ADJUSTABLE LINEAR SHOWER DRAIN SYSTEM

(71) Applicant: MLW Investments L.L.C., Longmont, CO (US)

(72) Inventor: David D. Larson, Arvada, CO (US)

(73) Assignee: MLW INVESTMENTS L.L.C., Longmont, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/946,836

(22) Filed: Sep. 16, 2022

(65) Prior Publication Data

US 2023/0085447 A1 Mar. 16, 2023

Related U.S. Application Data

(63) Continuation of application No. 16/988,081, filed on Aug. 7, 2020, now Pat. No. 11,454,017.

(60) Provisional application No. 62/884,257, filed on Aug. 8, 2019.

(51) Int. Cl.
*E03F 5/04* (2006.01)

(52) U.S. Cl.
CPC .... *E03F 5/0408* (2013.01); *E03F 2005/0413* (2013.01)

(58) Field of Classification Search
CPC ..... E03F 5/0408; E03F 5/0407; E03F 2005/0413
USPC ..... 4/679
See application file for complete search history.

(56) References Cited

U.S. PATENT DOCUMENTS

| | | | | |
|---|---|---|---|---|
| 8,239,974 | B2 * | 8/2012 | Erlebach | E03F 5/04 4/290 |
| 11,454,017 | B2 | 9/2022 | Larson | |
| 2011/0023978 | A1 | 2/2011 | Keizers et al. | |
| 2011/0162137 | A1 | 7/2011 | Kik, Sr. | |
| 2011/0203979 | A1 | 8/2011 | Schlueter | |
| 2018/0038091 | A1 * | 2/2018 | Ismert | E03F 5/0401 |
| 2020/0284012 | A1 * | 9/2020 | Kolarec | E03C 1/281 |
| 2021/0381216 | A1 | 12/2021 | Stokes et al. | |

OTHER PUBLICATIONS

Notice of Allowance for U.S. Appl. No. 16/988,081, dated May 25, 2022 8 pages.

* cited by examiner

*Primary Examiner* — Huyen D Le
(74) *Attorney, Agent, or Firm* — Sheridan Ross P.C.

(57) ABSTRACT

Described are embodiments of a modular adjustable linear shower drain system. The drain system is customizable in overall length by cutting portions of the drain system while on-site and prior to assembly. The individual components of the system are made to an oversized, or standard, length and then cut to a desired installation size. Once cut on-site, the components are fit together forming the modular adjustable linear shower drain system. The drain system also includes a height-adjustable shower grill that can be set to match a surrounding tiled area height and angle. The shower grill height is set by adjusting screws disposed in the shower grill and which are in contact with portions of the drain system.

20 Claims, 10 Drawing Sheets

MODULAR ADJUSTABLE LINEAR SHOWER DRAIN SYSTEM

CROSS REFERENCE TO RELATED APPLICATION

The present application is a continuation of U.S. patent application Ser. No. 16/988,081, filed Aug. 7, 2020, which claims the benefit of and priority, under 35 U.S.C. § 119, to U.S. Provisional Application Ser. No. 62/884,257, filed Aug. 8, 2019, entitled "Modular Adjustable Linear Shower Drain System," the entire disclosure of which is hereby incorporated herein by reference, in its entirety, for all that it teaches and for all purposes.

FIELD

The present disclosure is generally directed to drains and, in particular, toward linear shower drains.

BACKGROUND

Showers, steam rooms, and other areas requiring a reliable drainage of water generally include some type of drain system. Drain systems may include linear shower drains, round shower drains, square shower drains, etc., that are connected to a drain pipe. Regardless of the type of drainage system, most conventional shower drains come in a limited number of standard sizes, which are selected by an installer to suit the size of a room.

SUMMARY

Because most conventional shower drains are made to standard prefabricated sizes, installers are limited by the constraints of available products and installation site dimensions. Further, installers of these conventional shower drains can be hindered by the location of the drain pipe at an installation site. In some cases, the drain pipe may be located too close to a wall or joist to fit a particular prefabricated shower drain. In other cases, the drain pipe may be located in an off-center position in an installation site limiting the number of drain products that can fit in the site from a dimensional and/or an aesthetic perspective. In any event, relocating a drain pipe in an installation site can be costly and time consuming.

It is with respect to the above issues and other problems that the embodiments presented herein were contemplated. In general, embodiments of the present disclosure provide a modular adjustable linear shower drain system that allows on-site custom fitting in a shower or other area. The modular adjustable linear shower drain system includes a number of parts that can be cut on-site (e.g., with a wet saw, hacksaw, circular saw, etc.) and assembled together.

The previously mentioned issues and other needs are addressed by the various aspects, embodiments, and/or configurations of the present disclosure. Also, while the disclosure is presented in terms of exemplary embodiments, it should be appreciated that individual aspects of the disclosure can be separately claimed.

In some embodiments, a modular adjustable linear shower drain system having a customizable overall length and install height is provided, comprising: a drain interface adapter configured to interface with a drain pipe at an installation site; a trough interconnected to the drain interface adapter at one end of the drain interface adapter; a drainage slope insert disposed in a channel of the trough, wherein the drainage slope insert slopes from a first dimension to a shorter second dimension at the drain interface adapter; and a grill comprising a plurality of adjustable screws in contact with surfaces of the drain interface adapter and the trough, the grill nested in a receiving portion of the drain interface adapter and the trough, wherein the grill is adjustable in height relative to the drain interface adapter and the trough via turning the plurality of adjustable screws in a rotational direction, wherein an overall length of the modular adjustable linear shower drain system is adjustable by cutting a portion of material from the trough, the drainage slope insert, and the grill prior to assembly, and wherein the install height is adjustable by turning the plurality of adjustable screws in the rotational direction.

In some embodiments, a modular adjustable linear shower drain system is provided, comprising: a drain interface adapter comprising: a drain tube disposed in a center of the drain interface adapter, the drain tube comprising a hollow portion running from a first end to a second end of the drain tube; a flange disposed perpendicular to the drain tube, wherein the flange is substantially rectangular, wherein the flange is attached to the drain tube at the first end, and wherein the flange is centered on the drain tube; a fluid channel running from one end of the flange to an opposite end of the flange across the drain tube; a first recessed cutout disposed on the one end of the flange and disposed on the opposite end of the flange; and a second recessed cutout disposed in the fluid channel at the one end of the flange and disposed in the fluid channel at the opposite end of the flange; a first trough comprising a channel running along a length of the first trough from an open end of the first trough to a closed end of the first trough, wherein the first trough is interconnected to the drain interface adapter at the first recessed cutout disposed on the one end of the flange, and wherein a length of the first trough is adjustable by cutting a portion of material from the open end of the first trough; a second trough comprising a channel running along a length of the second trough from an open end of the second trough to a closed end of the second trough, wherein the second trough is interconnected to the drain interface adapter at the first recessed cutout disposed on the opposite end of the flange, and wherein a length of the second trough is adjustable by cutting a portion of material from the open end of the second trough; a grill spanning a length of the first trough, the drain interface adapter, and the second trough, wherein a length of the grill is adjustable by cutting a portion of material from at least one end of the grill, and wherein a pair of translation grooves are disposed in the grill running the length of the first trough, the drain interface adapter, and the second trough; a height-adjust plate disposed in the pair of translation grooves, the height-adjust plate comprising a tapped hole disposed therein; and a height-adjust screw threadedly-engaged with the tapped holes, wherein an end of the height-adjust screw contacts a surface in the first trough, and wherein a distance of a surface of the grill relative to the surface of the first trough is adjustable via turning the height-adjust screw in the tapped hole of the height-adjust plate.

In some embodiments, a method of customizing an overall length and install height of a shower drain is provided, comprising: interfacing a drain interface adapter with a drain pipe at an installation site; connecting a trough to the drain interface adapter at one side of the drain interface adapter, wherein a length of the trough is adjustable by cutting a portion of material from the trough; inserting a drainage slope insert in a channel of the trough, wherein the drainage slope insert slopes from a first dimension to a shorter second dimension at the drain interface adapter, and wherein a length of the drainage slope insert is adjustable by cutting a portion of material from the drainage slope insert; nesting a grill comprising a plurality of set screws in a receiving portion of the drain interface adapter, wherein the plurality of screw sets contacts surfaces of the drain interface adapter and the trough, and wherein a length of the grill is adjustable by cutting a portion of material from the grill; and adjusting a height of the grill relative to the drain interface adapter and the trough via turning the plurality of set screws in a rotational direction.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below

Figure 1A:
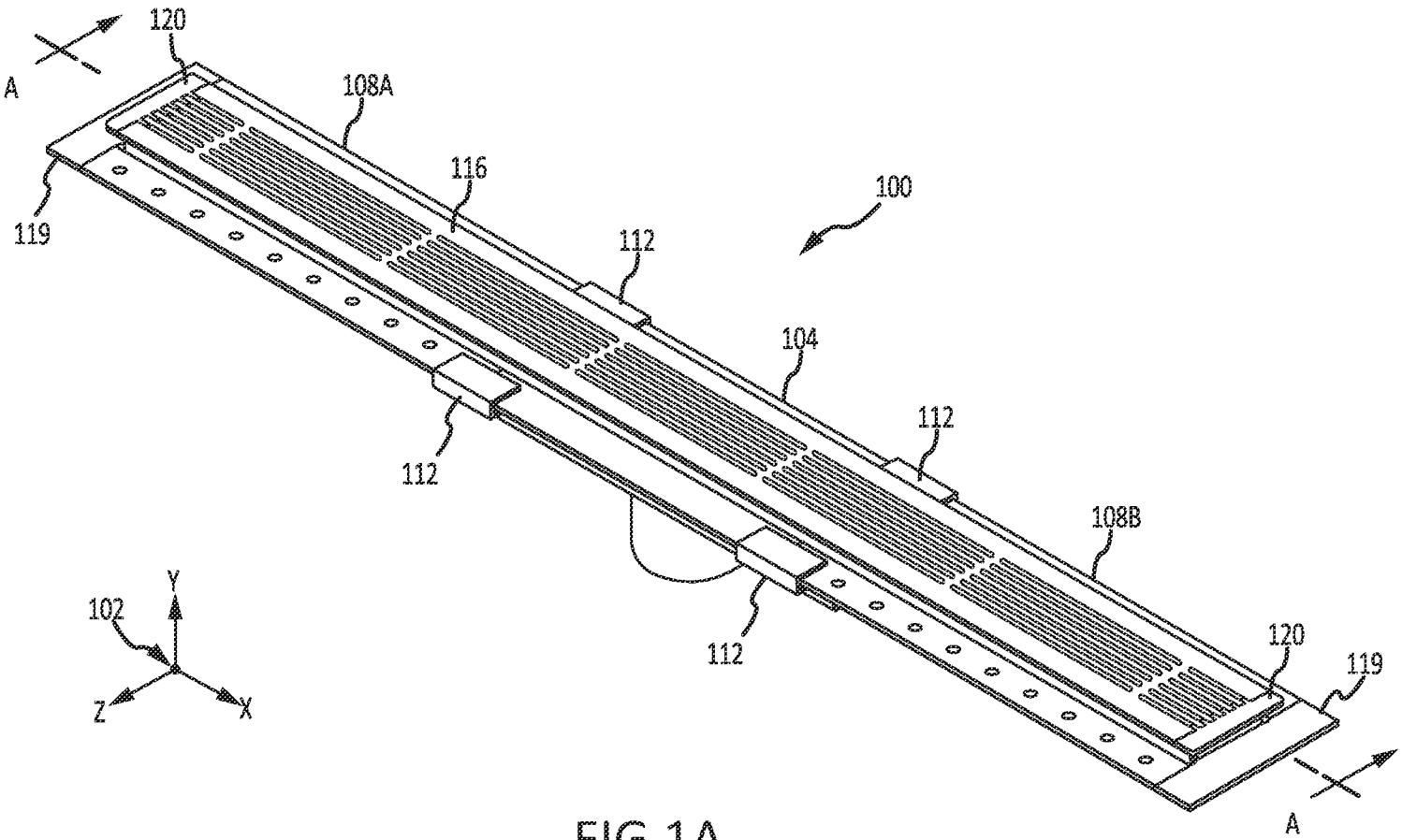
FIG. 1A is a perspective view of a modular adjustable linear shower drain system in accordance with embodiments of the present disclosure.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

DETAILED DESCRIPTION

Embodiments of the present disclosure will be described in connection with drains and, in particular, shower drain systems. In some embodiments, the devices and systems disclosed herein may interconnect with one or more existing, or pre-installed, plumbing components in a building or structure (e.g., drain pipes, shower pans, etc.).

FIGS. 1A-1E show various views of a modular adjustable linear shower drain system 100 in accordance with embodiments of the present disclosure. The modular adjustable linear shower drain system 100 comprises a drain interface adapter 104 that is configured to attach to, or otherwise interface with, an existing drain pipe at an installation site. Although described in conjunction with shower areas, it should be appreciated that the modular adjustable linear shower drain system may be installed in any area where fluid is collected and drained. Examples of the installation site or area may include, but are in no way limited to, a shower, bath, steam room, car wash, holding cell, garage, basement, water park, and/or other area where drains are installed or capable of being installed.

As provided herein, reference may be made to the coordinate system 102 in defining a position, arrangement, and/or size of components making up the modular adjustable linear shower drain system 100. As shown in FIGS. 1A-1E, a longitudinal length of the modular adjustable linear shower drain system 100 runs along the X-axis of the coordinate system 102, a width of the modular adjustable linear shower drain system 100 may be defined by a measurement taken along the Z-axis of the coordinate system 102, and a height of the modular adjustable linear shower drain system 100 may be defined by Y-axis of the coordinate system 102. In addition to the various axes of the coordinate system 102, planes associated with the components of the modular adjustable linear shower drain system 100 may be defined by the various planes (e.g., the XY-plane, XZ-plane, and the YZ-plane) of the coordinate system 102.

The modular adjustable linear shower drain system 100 further comprises two troughs 108A, 108B connected to either side of the drain interface adapter 104. Each of the two troughs 108A, 108B include a stepped internal area comprising a drainage slope insert receiving area configured to receive a drainage slope insert 110A, 110B, a contact support surface 132 configured to contact a height-adjust screw 118 of a height-adjust plate 114 and/or end cap 120, and a shower grill clearance area 134 configured to accommodate a portion of a shower grill 116. Similar, if not identical, features may be disposed in the drain interface adapter 104.

In some embodiments, the modular adjustable linear shower drain system 100 may be assembled in pieces allowing the modular adjustable linear shower drain system 100 to be custom fit on-site at an installation area. For example, and as described in greater detail in conjunction with FIG. 2, the drain interface adapter 104 may be mounted to a drain pipe at the installation site and the length for each of the troughs 108A, 108B may be measured. Once measured, each of the troughs 108A, 108B may be cut to the measured (e.g., desired) length and attached to the drain interface adapter 104 via one or more assembly clips 112. While the troughs 108A, 108B are connected to the drain interface adapter 104, the dimension for the shower grill 116 may be measured along the X-axis from an internal end side of the first trough 108A to an internal end side of the second trough 108B.

In some embodiments, the drain interface adapter 104 may be partially or fully coated with a nonstick or Polytetrafluoroethylene (PTFE) (e.g., Teflon) material. For instance, the inner surfaces of the drain interface adapter 104 may be coated with PTFE or the like to prevent or inhibit, among other things, the build-up of chemicals, hair, or other detritus that passes through the drain interface adapter 104 into the drain. The coating material may be coated, deposited, or formed on the one or more surfaces of the drain interface adapter 104.

The components of the modular adjustable linear shower drain system 100 may be made from plastic, metal, composites, and/or a combination thereof. For instance, the drain interface adapter 104, the troughs 108A, 108B, and/or the drainage slope inserts 110A, 110B may be made from plastic including, but in no way limited to, acrylonitrile butadiene styrene (ABS), polyvinyl chloride (PVC), chlorinated polyvinyl chloride (CPVC), polyethylene (PE), high-density polyethylene (HDPE), low-density polyethylene (LDPE), combinations thereof, and/or the like. The height-adjust plates 114, the shower grill 116, and/or the end caps 120 may be made from metal including, but in no way limited to, aluminum, stainless steel, galvanized steel, bronze, brass, titanium, alloys thereof, etc.

Referring to FIG. 1A, the modular adjustable linear shower drain system 100 comprises a shower grill 116 that nests with a portion of at least one of the stepped internal areas of the troughs 108A, 108B and drain interface adapter 104. In some embodiments, the shower grill 116 may include an end cap 120 connected to each end of the shower grill 116. As described herein, the end cap 120 may comprise height-adjust features (e.g., set screws disposed in tapped holes in the end cap 120, etc.) to adjust the overall height of the shower grill 116 relative to each of the troughs 108A, 108B and the drain interface adapter 104, and/or relative to tile installed around the shower grill 116.

Figure 1B:
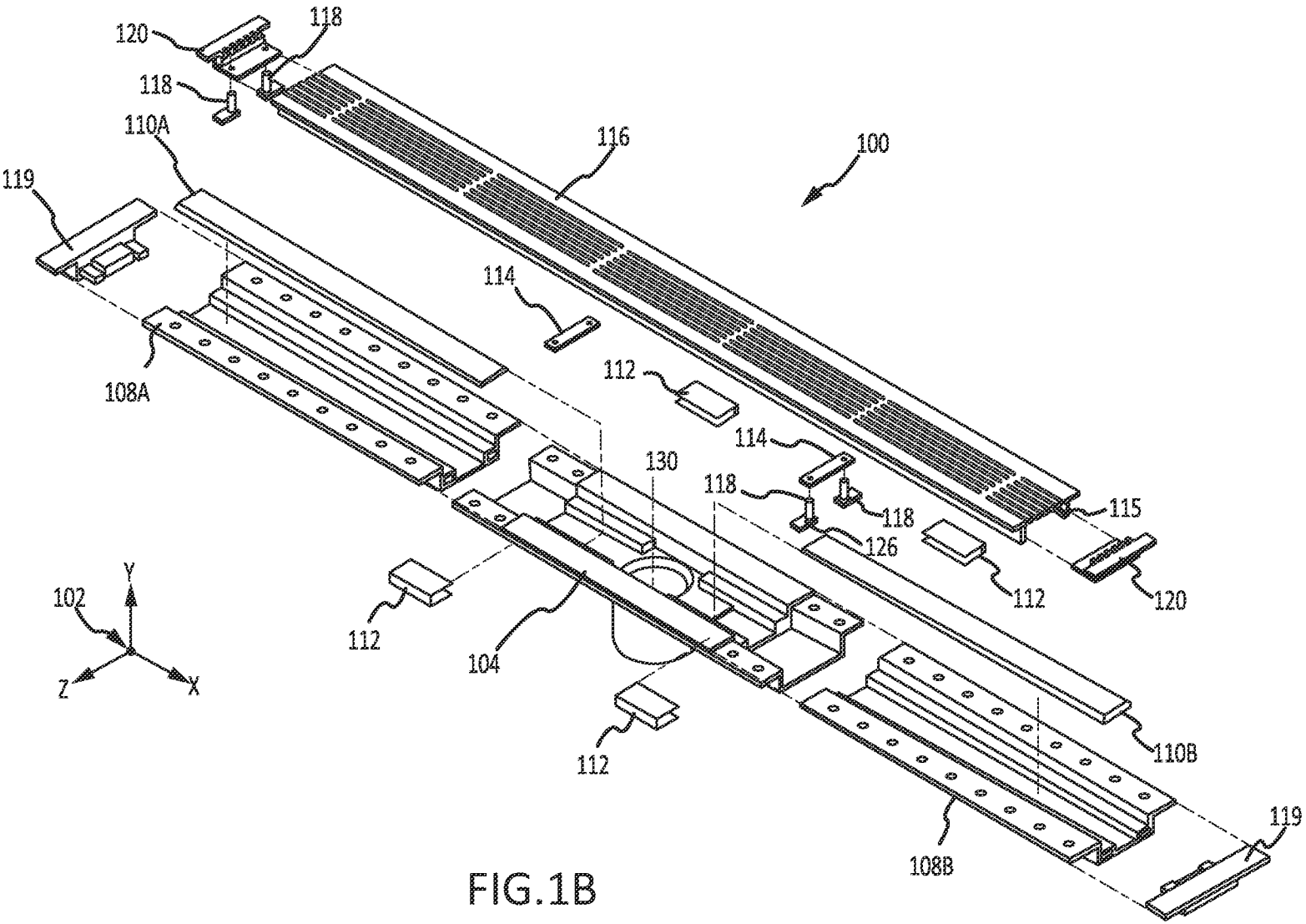
FIG. 1B is an exploded perspective view of the modular adjustable linear shower drain system of FIG. 1A.
Figure 1C:
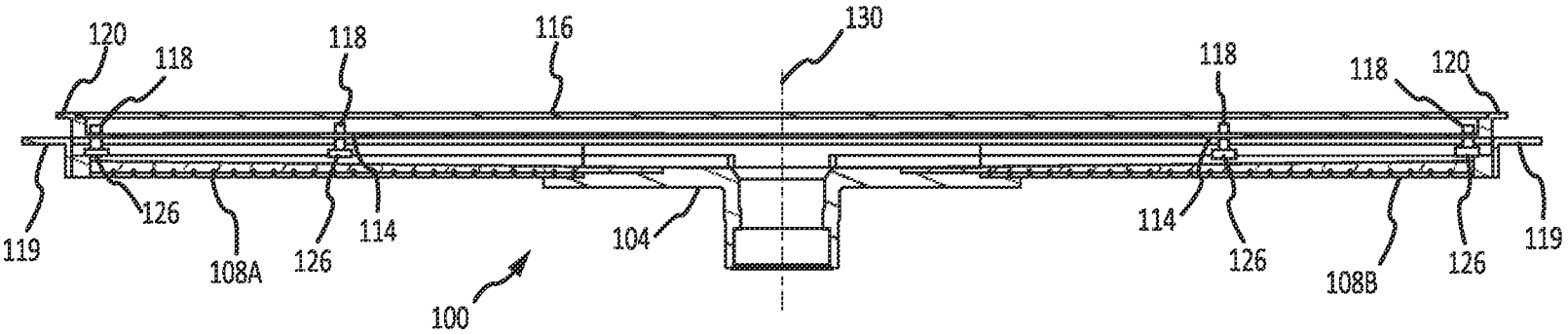
FIG. 1C is a section view of the modular adjustable linear shower drain system taken through line A-A shown in FIG. 1A.

In some embodiments, the end cap 120 may include a flange that interconnects with a translation groove 115 running the length of the shower grill 116. As shown in FIGS. 1B and 1C, the end cap 120 is aligned with and inserted into the translation groove 115, respectively. The flange of the end cap 120 may be slip-fit, or press-fit, into the translation groove 115 of the shower grill 116. Additionally or alternatively, a height-adjust plate 114 may be inserted into the translation groove 115 of the shower grill 116 and slid to an appropriate position along the X-axis of the modular adjustable linear shower drain system 100 for providing a support for the shower grill 116 and providing a height adjustment similar, if not identical, to the height-adjust features of the end cap 120. In one embodiment, as weight is applied to the shower grill 116 along the Y-axis (e.g., in a direction toward the troughs 108A, 108B and drain interface adapter 104), the height-adjust screw 118 may provide support for the shower grill 116 at one or more contact points 132A, 132B, etc.

As shown in FIG. 1B, the modular adjustable linear shower drain system 100 may include custom fit drainage slope inserts 110A, 110B that are disposed in the lowest stepped internal area of the troughs 108A, 108B, and in a portion of the drain interface adapter 104. In some embodiments, the drainage slope inserts 110A, 110B may be slip-fit or press-fit into the receiving features of the troughs 108A, 108B. Additionally or alternatively, the drainage slope inserts 110A, 110B may be bonded, caulked, or otherwise sealed inside the troughs 108A, 108B.

Figure 1D:
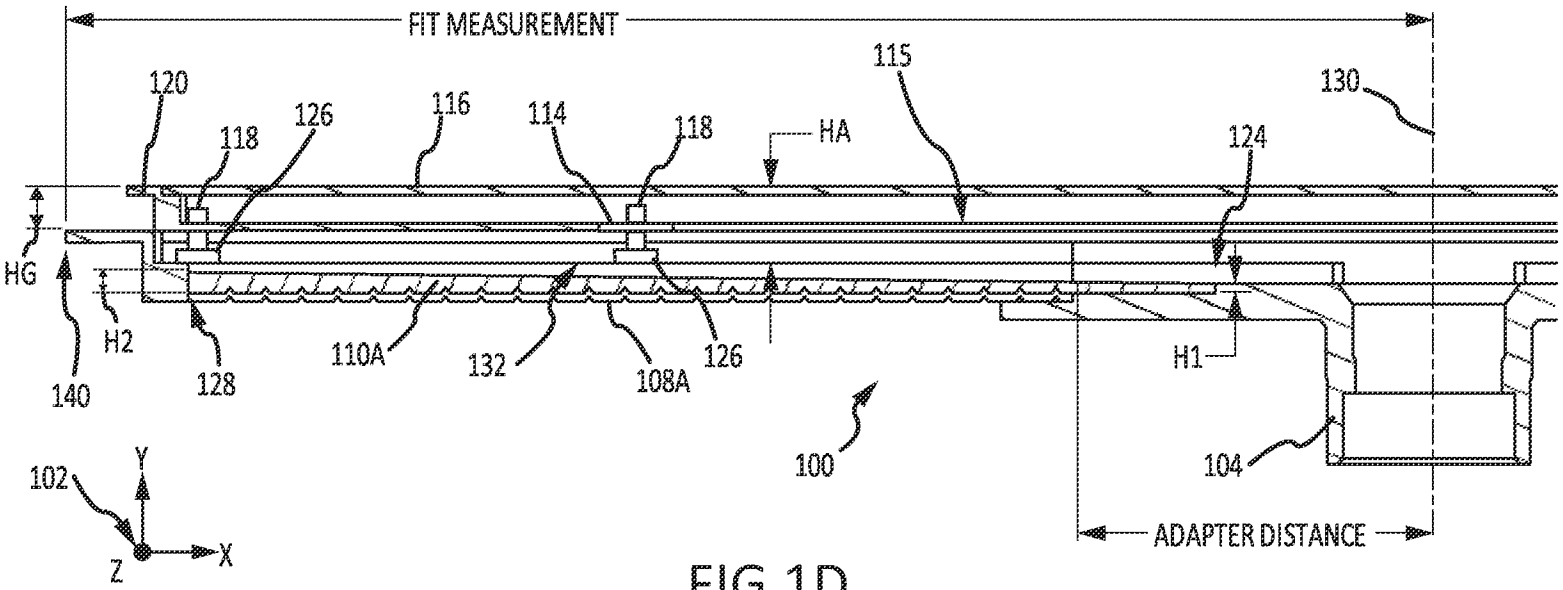
FIG. 1D is a detail section view of one side of the modular adjustable linear shower drain system shown in FIG. 1C.

Referring now to FIGS. 1C-1D, the drainage slope inserts 110A, 110B may include a slope, or angle, running along the X-axis from a first interface end 124 to a second interface end 128. The slope may allow water, or other fluids, that pass through, or around, the shower grill 116 to drain toward the drain interface adapter 104 and the drain pipe. It is an aspect of the present disclosure that the drainage slope inserts 110A, 110B may each slope toward the centerline 130 of the modular adjustable linear shower drain system 100. In some embodiments, the drainage slope inserts 110A, 110B may include a first height, H1, disposed at the first interface end 124 tapering along the X-axis toward a second greater height, H2, disposed at the second interface end 128. Among other things, this difference in height may provide a gradual slope that allows fluid to drain from the outermost portions of the modular adjustable linear shower drain system 100 to the drain pipe. In some embodiments, the height of the drainage slope inserts 110A, 110B measured at the first end interface 124 (e.g., along the Y-axis) may remain constant, and may be flush with the interface adapter 104.

As described herein, the modular adjustable linear shower drain system 100 may be cut to fit a specific dimension at an installation area. More specifically, the components of the modular adjustable linear shower drain system 100 may be cut to any desired length along the X-axis to fit a specific dimension associated with an installation site. Custom fitting of the modular adjustable linear shower drain system 100 will be described at least in conjunction with FIG. 1D. FIG. 1D shows a detail section view of the modular adjustable linear shower drain system 100 illustrating the arrangement of components from the centerline 130 to an outermost portion along the X-axis. In some embodiments, the modular adjustable linear shower drain system 100 may be symmetrical about the modular adjustable linear shower drain system 100 and, as such, reference to the dimensions or arrangements of components associated with one side of the modular adjustable linear shower drain system 100 may be similar, if not identical to the other side of the modular adjustable linear shower drain system 100.

In fitting the modular adjustable linear shower drain system 100 to a desired dimension, a Fit Measurement may be taken on-site from the center of the drain pipe (e.g., corresponding to the centerline 130 of the drain interface adapter 104) to an outermost point 140 along the X-axis. Based on the Fit Measurement, the first trough 108A may be cut to length. For instance, the length of the first trough 108A may be cut to a size that is substantially equal to the Fit Measurement minus the Adapter Distance (see, e.g., FIG. 1D). The first trough 108A may be cut using a wet saw, hack saw, circular saw, etc. As described above, the material of the first trough 108A may be a plastic that can be cut with minimal effort. In any event, the first trough 108A may be a molded piece at one or more defined (e.g., standard) lengths. The length of the first trough 108A may be cut from the open end (e.g., opposite the outermost point 140) to size. Once cut to size, the first trough 108A may be joined to the drain interface adapter 104 via adhesive, chemical bond, etc., and/or clipped together at an upper flange via one or more assembly clips 112.

Next, the first drainage slope insert 110A may be fit to the corresponding receiving area in the first trough 108A and the drain interface adapter 104. In some embodiments, once the components are connected together, a measurement may be taken inside the drain interface adapter 104 and the first trough 108A from the first interface end 124 to the second interface end 128. As the first height, H1, of the first drainage slope insert 110A is sized to be substantially equal to the depth of the receiving area in the drain interface adapter 104, the first drainage slope insert 110A is cut to length at the end closest to the second greater height, H2. Once cut to size, the first drainage slope insert 110A may be inserted into the corresponding receiving areas of the drain interface adapter 104 and the first trough 108A. In some embodiments, the first drainage slope insert 110A may be joined to the receiving areas of the drain interface adapter 104 and the first trough 108A via an adhesive and/or a chemical bond. In one embodiment, the first drainage slope insert 110A may be inserted into to the receiving areas of the drain interface adapter 104 and the first trough 108A via a slip-fit or a press-fit.

The size of the shower grill 116 may be determined by measuring from an inside surface of the first internal stepped area at one end of the modular adjustable linear shower drain system 100 along the X-axis to the opposing inside surface of the first internal stepped area disposed at the other end of the modular adjustable linear shower drain system 100. The shower grill 116 may be cut using a wet saw, hack saw, circular saw, etc. In some embodiments, the shower grill 116 may be an extruded piece that is extruded to one or more defined (e.g., standard) lengths. In some embodiments, the shower grill 116 may include a number of slots, holes, apertures, and/or other features in an upper surface thereof (e.g., running along the XZ-plane) that allow fluid to pass therethrough. These features may be arranged in a pattern along the length of the shower grill 116. It is an aspect of the present disclosure that the shower grill 116 may be cut in such a manner that the features are centered on the modular adjustable linear shower drain system 100 (e.g., centerline symmetrical from the centerline 130 of the modular adjustable linear shower drain system 100). For example, rather than only cutting one end of the shower grill 116 when cutting the shower grill 116 to size, the determined length dimension may be measured from a center of one of the features of the shower grill 116. In this example, the determined measurement may be divided by two and the first cut of the shower grill 116 may be made from the center of one of the features to a first point disposed a first direction along the X-axis at the divided dimension and the second cut of the shower grill 116 may be made from the center of the one of the features to a second point disposed an opposite second direction along the X-axis at the divided dimension.

Figure 1E:
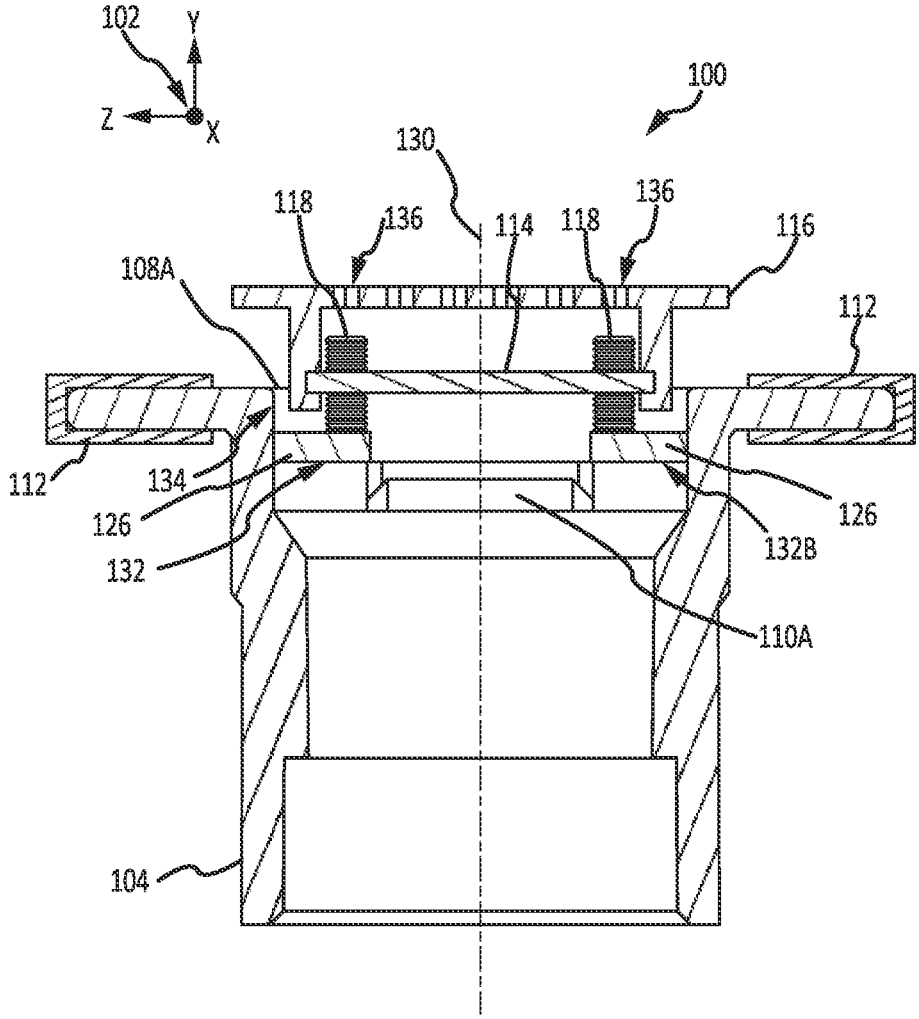
FIG. 1E is a section view of the modular adjustable linear shower drain system taken through the center of the drain interface adapter along the YZ-plane shown in FIG. 1A.

In some embodiments, the height of the shower grill 116 may be adjusted relative to the troughs 108A, 108B and the drain interface adapter 104. Among other things, this height adjustment allows the shower grill 116 to be adjusted to closely match a surrounding (e.g., tiled) environment. Referring now to FIG. 1E, a section view of the modular adjustable linear shower drain system 100 taken through the center of the drain interface adapter along the YZ-plane is shown. As illustrated in FIG. 1E, the modular adjustable linear shower drain system 100 may include one or more height-adjust screws 118 to adjust a height and/or angle of the shower grill 116 relative to the rest of the modular adjustable linear shower drain system 100 and/or a surrounding environment. The height-adjust screws 118 may be disposed in tapped holes of the height-adjust plate 114 and/or the end cap 120, which are in turn disposed in the translation groove 115 of the shower grill 116. The height-adjust screws 118 may be configured as set screws including a tool receiving feature (e.g., slot, flat head feature, groove, star, Phillips head feature, anti-cam-out features, security fastening features, etc.) disposed in the top surface, which can be adjusted by a corresponding tool (e.g., a screwdriver, hex (e.g., Allen) key, anti-cam-out driver (e.g., Torx® driver), etc.). In one embodiment, as the height-adjust screws 118 are unscrewed (e.g., in the case of a right-handed thread turned counter-clockwise) the associated height-adjust plate 114 and/or the end cap 120 may move along the Y-axis in a direction toward from the troughs 108A, 108B and the drain interface adapter 104 decreasing a height (e.g., HG shown in FIG. 1D) of the shower grill 116 in the modular adjustable linear shower drain system 100. When the height-adjust screws 118 are turned in a clockwise direction (e.g., in the case of the right-handed thread above) the associated height-adjust plate 114 and/or the end cap 120 may move along the Y-axis in a direction away from the troughs 108A, 108B and the drain interface adapter 104 increasing a height (e.g., HG shown in FIG. 1D) of the shower grill 116 in the modular adjustable linear shower drain system 100. In some embodiments, the shower grill 116 may include one or more shower grill slots 136, which may be disposed above the height-adjust screws 118. Among other things, the location of the shower grill slots 136 above the height-adjust screws 118 allows for easy access of the adjustment tool. In some embodiments, the height-adjust screws 118 may be made from metal.

In one embodiment, the height-adjust screws 118 may incorporate at least one foot 126 (e.g., made from plastic, metal, or other material) as shown in FIGS. 1C-1E. The at least one foot 126 may contact an inner surface of the troughs 108A, 108B when installed, or may maintain and/or guide the assembled shower grill 116 in the center of the troughs 108A, 108B. In some embodiments, the at least one foot 126 may contact only one surface of the troughs 108A, 108B; as shown in FIG. 1E, the at least one foot 126 may contact the troughs 108A, 108B at the one or more contact points 132A, 132B, etc., and may extend in the Z-axis direction without directly contacting a second inner surface of the troughs 108A, 108B. The foot 126 may be shaped to have an outer periphery that is sized larger than an outer periphery (e.g., diameter, etc.) of the height-adjust screws 118.

In one embodiment, the shower grill 116 may be adjusted via the height-adjust screws 118 to match an angle of a floor, or tiled surrounding, in an installation site. For instance, the angle of the shower grill 116 may be set by adjusting one set of the height-adjust screws 118 disposed on one side of the centerline 130 (as shown in FIG. 1E) and/or adjusting the other set of the height-adjust screws 118 disposed on the other side of the centerline 130 until a desired height and/or angle of the shower grill 116 relative to the remainder of the modular adjustable linear shower drain system 100 and/or the tiled area is set. It is an aspect of the present disclosure that the shower grill clearance area 134 allows for angular and height adjustments as well as providing clearance for the shower grill 116 to move along the Z-axis and/or the X-axis. In some embodiments, the shower grill clearance area 134 may completely surround the shower grill 116.

In one embodiment, the troughs 108A, 108B may be closed and/or covered with an end cap 119. In embodiments where both the troughs 108A, 108B have an end cap 119, the end caps 119 may be formed similarly to or the same as one another. In some embodiments, the end cap 119 may be similar to or the same as the end cap 120. For instance, the end cap 119 may be configured to support a first end of either of the troughs 108A, 108B (e.g., if the troughs 108A, 108B are created through a method of extrusion). In some embodiments, the end cap 119 may include protrusion structures matching the profile of the first end of either of the troughs 108A, 108B. The protrusion structures may allow the end cap 119 to more easily secure to the first end of either of the troughs 108A, 108B. Additionally or alternatively, the end cap 119 may provide a channel protrusion that provides additional structural support to the first end of either of the troughs 108A, 108B.

Figure 2:
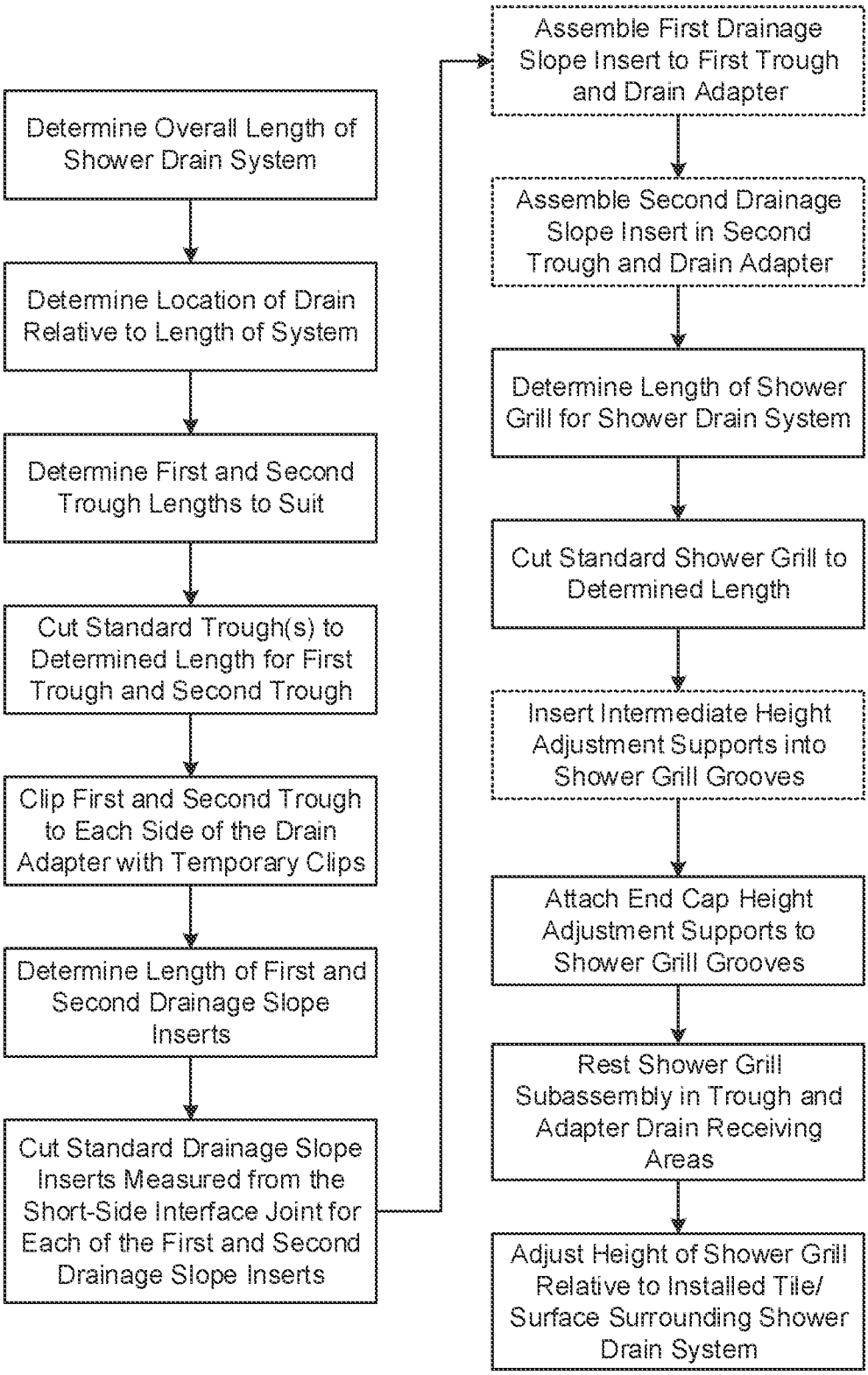
FIG. 2 is a flow diagram of a method of assembling and fitting the modular adjustable linear shower drain system in an installation site in accordance with embodiments of the present disclosure.

FIG. 2 is a flow diagram of a method of assembling and fitting the modular adjustable linear shower drain system in an installation site in accordance with embodiments of the present disclosure. As provided above, the method may begin by determining an overall desired length for the modular adjustable linear shower drain system 100. The drain interface adapter 104 may be interconnected with the drain pipe in the installation area. Next, the location of the drain pipe (e.g., the centerline 130 of the drain interface adapter 104) relative to the edges of the installation site can be measured. Based on these measurements, the first trough 108A and the second trough 108B may be cut appropriately. In some embodiments, the length of the troughs 108A, 108B may be cut from a single molded part and/or two molded parts (e.g., one part for each side of the modular adjustable linear shower drain system 100). The troughs 108A, 108B may then be clipped to the drain interface adapter 104 via two or more assembly clips 112. Prior to clipping the troughs 108A, 108B together with the assembly clips 112, the contacting surfaces of the troughs 108A, 108B and the drain interface adapter 104 may be prepared for bonding or adhering the components together (e.g., using PVC solvent cement, adhesive, and/or the like). Once these components are clipped together, the length of the first drainage slope insert 110A and the second drainage slope insert 110B may be measured from the first interface end 124 to the second interface end 128. The drainage slope inserts 110A, 110B may be cut from the larger end (e.g., the H2 end) of the slope such that the shorter end (e.g., the H1 end) is substantially the same height as the depth of the receiving channel in the drain interface adapter 104.

The method may optionally continue by assembling the first drainage slope insert 110A to the first trough 108A via a chemical and/or adhesive bond. In some embodiments, the first drainage slope insert 110A may be caulked into the first trough 108A and the drain interface adapter 104. Similarly, the method may continue by assembling the second drainage slope insert 110B to the second trough 108B via a chemical and/or adhesive bond. In some embodiments, the second drainage slope insert 110B may be caulked into the second trough 108B and the drain interface adapter 104. It is an aspect of the present disclosure, where both parts are made from PVC to bond the drainage slope inserts 110A, 110B to their respective troughs 108A, 108B using a PVC solvent cement.

Next, the length of the shower grill 116 may be determined. In some embodiments, this determination may include measuring a length of the internal receiving area of the connected troughs 108A, 108B and drain interface adapter 104 of the modular adjustable linear shower drain system 100. From this measured length a predetermined clearance amount (e.g., corresponding to a dimension of the shower grill clearance area 134 and the end caps 120) may be subtracted to obtain the overall length of the shower grill 116. As provided above, the shower grill 116 may include a number of shower grill slots 136 disposed in an upper surface of the shower grill 116 (e.g., running along the XZ-plane) that are configured to allow fluid to pass therethrough. These shower grill slots 136 may be arranged in a pattern along the length of the shower grill 116. It is an aspect of the present disclosure that the shower grill 116 may be cut in such a manner that the shower grill slots 136, or the pattern of shower grill slots 136, are centered on the modular adjustable linear shower drain system 100 (e.g., centerline symmetrical from the centerline 130 of the modular adjustable linear shower drain system 100). For example, rather than only cutting one end of the shower grill 116 when cutting the shower grill 116 to size, the determined length dimension may be measured from a center of one of the pattern of shower grill slots 136 of the shower grill 116. In this example, the determined measurement may be divided by two and the first cut of the shower grill 116 may be made from the center of one of the pattern of shower grill slots 136 to a first point disposed a first direction along the X-axis at the divided dimension and the second cut of the shower grill 116 may be made from the center of the one of the pattern of shower grill slots 136 to a second point disposed an opposite second direction along the X-axis at the divided dimension.

Depending on the overall length of the shower grill 116, the method may continue by determining whether one or more height-adjust plates 114 (i.e., intermediate height adjustment supports) need to be inserted in the shower grill 116 via the translation grooves 115 running the length of the shower grill 116. In some embodiments, the shower grill 116 may deflect or bend along a portion of the length when the overall length of the shower grill 116 is greater than a predetermined distance. In this case, one or more height-adjust plates 114 may be inserted into the translation grooves 115 and slid to an appropriate position along the length of the shower grill 116. In some embodiments, a height-adjust plate 114 may be fixed in a desired position along the X-axis by deforming a portion of material of the shower grill 116 on either side of the height-adjust plate 114 (e.g., by center-punching a portion of the material on either side of the height-adjust plate 114), by drilling and pinning the height-adjust plate 114 to the shower grill 116, by inserting an adhesive in the translation groove 115 between the height-adjust plate 114 and the shower grill 116, and/or by otherwise fastening the height-adjust plate 114 to the shower grill 116.

Once any necessary height-adjust plates 114 have been inserted, the end caps 120 may be connected to the shower grill 116. The end caps 120 may be configured to support the ends of the shower grill 116 and/or a portion of the shower grill slots 136 (e.g., if a cut line of the shower grill 116 falls along a portion of the shower grill slots 136). In some embodiments, the end cap 120 may include a comb structure to support and separate each slot of the shower grill slots 136 from one another. The comb structure (as shown in FIG. 14) may prevent deflection (e.g., in the XZ-plane and/or the XY-plane, etc.) of the material between the shower grill slots 136.

Figure 3A:
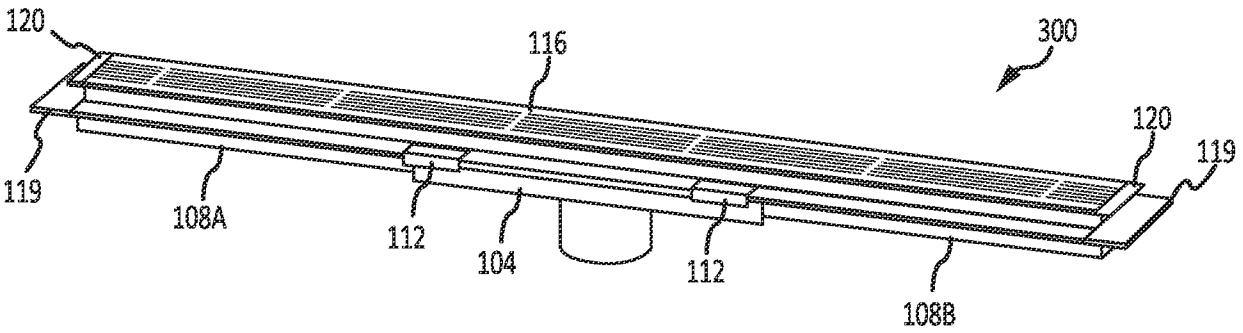
FIG. 3A is a perspective view of a modular adjustable linear shower drain system in a three-foot long configuration in accordance with embodiments of the present disclosure.
Figure 3B:
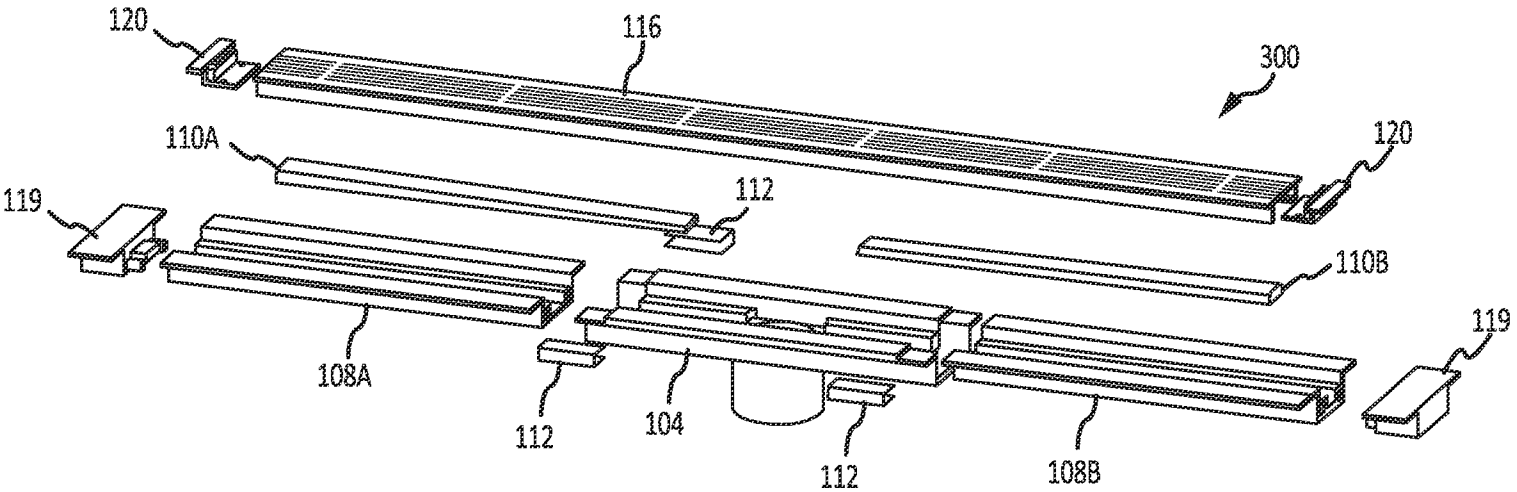
FIG. 3B is an exploded perspective view of the modular adjustable linear shower drain system in the three-foot long configuration shown in FIG. 3A.
Figure 4A:
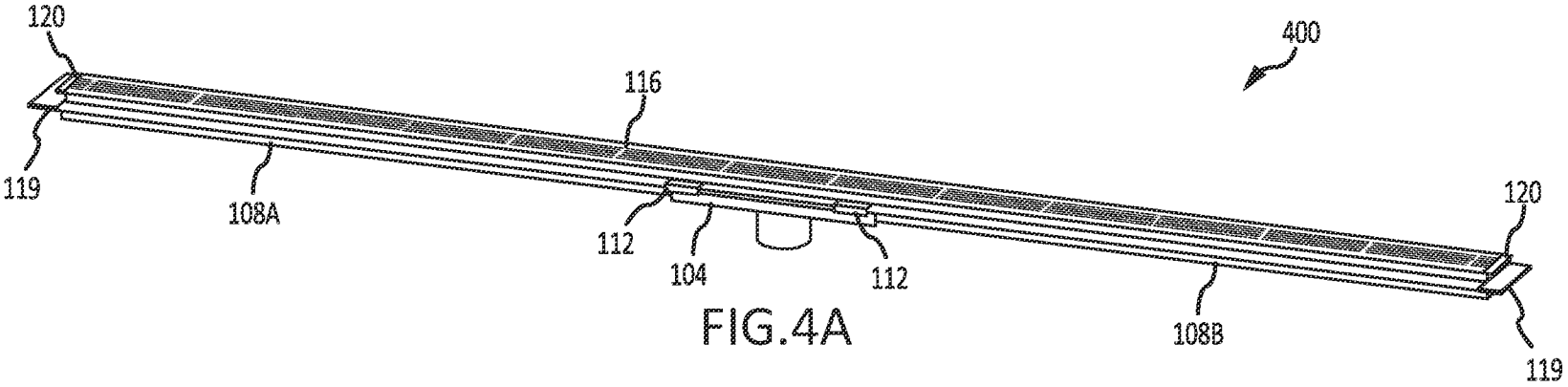
FIG. 4A is a perspective view of a modular adjustable linear shower drain system in a seven-foot long configuration in accordance with embodiments of the present disclosure.
Figure 4B:
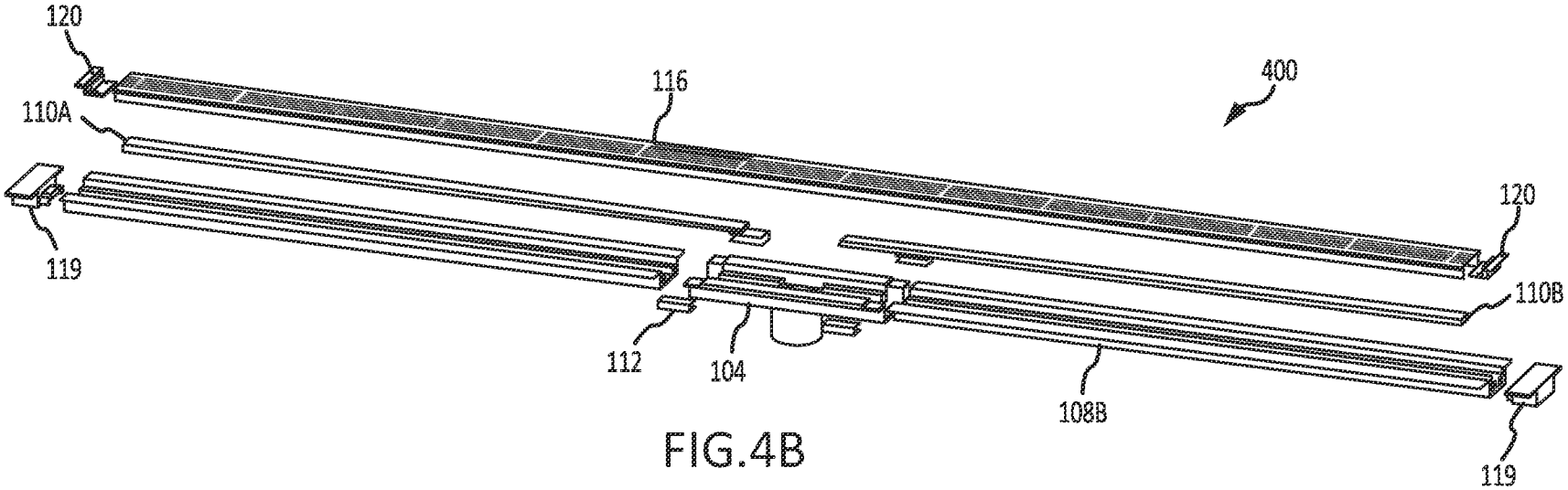
FIG. 4B is an exploded perspective view of the modular adjustable linear shower drain system in the seven-foot long configuration shown in FIG. 4A.

FIGS. 3A-3B show multiple views of a modular adjustable linear shower drain system 100 in a three-foot long configuration 300 in accordance with embodiments of the present disclosure. FIGS. 4A-4B show multiple views of a modular adjustable linear shower drain system in a seven-foot long configuration 400 in accordance with embodiments of the present disclosure. Views shown in FIGS. 3A-4B may omit showing some components of the modular adjustable linear shower drain system 100 for the purposes of clarity. The modular adjustable linear shower drain system 100 is not, however, limited to the three-foot long configuration 300 and/or the seven-foot long configuration 400, and different lengths may be created (e.g., by cutting various amounts of materials from the troughs 108A, 108B, the drainage slope inserts 110A, 110B, the shower grill 116, and/or combinations thereof).

In some embodiments, an installer may determine a desired size of the modular adjustable linear shower drain system 100 based on dimensions measured at an installation site. Once the desired size of drain is determined, the installer may select an appropriate configuration 300, 400 to install. The appropriate configuration may be determined as the configuration 300, 400 of the modular adjustable linear shower drain system 100 having the closest dimension to the desired size of drain. For example, when the dimensions measured at the installation site indicate that the size of the modular adjustable linear shower drain system 100 should be 34" from end to end with a center-oriented drain interface adapter 104, the installer may select the three-foot long configuration 300. As can be appreciated, cutting the three-foot long configuration 300 down to 34" only requires that 2 inches of material be removed from the selected configuration 300. In this example, if the installer had selected the seven-foot long configuration 400 instead, then 50" of material would have needed to be removed. Among other things, providing the modular adjustable linear shower drain system 100 in various "standard" length configurations (e.g., 3 feet long, 4 feet long, 5 feet long, 6 feet long, 7 feet long, 8 feet long, etc.) allows the appropriate size of modular adjustable linear shower drain system 100 to be selected to prevent waste.

In one embodiment, an installer may combine the components of different configurations 300, 400 to provide an appropriately sized modular adjustable linear shower drain system 100. For instance, an installer may measure a drain at an installation site that is located approximately 16" from a first edge and 30" from a second opposite edge. In this case, the installer could use the seven-foot long configuration 400 and remove material from each end to fit the off-center drain. However, the installer may determine that selecting a first trough 108A and a first drainage slope insert 110A from the three-foot long configuration 300 (for the 16" side) and a second trough 108B and a second drainage slope insert 110B from the seven-foot long configuration 400 may result in the least amount of material to be removed (e.g., waste, etc.) when forming the final installed modular adjustable linear shower drain system 100.

Figure 5:
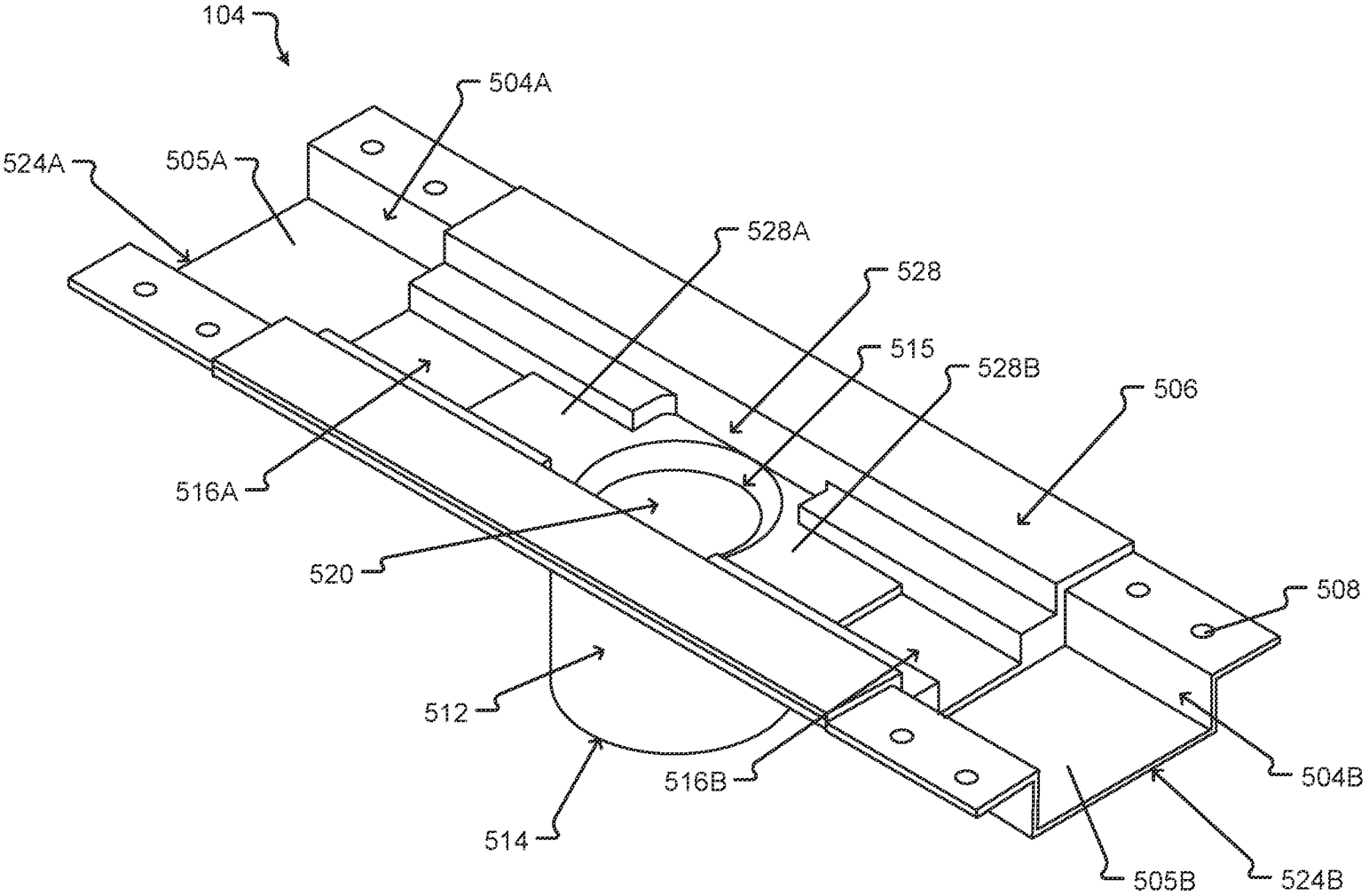
FIG. 5 shows a perspective view of a drain interface adapter of the modular adjustable linear shower drain system in accordance with embodiments of the present disclosure.

Turning now to FIG. 5, a perspective view of a drain interface adapter 104 of the modular adjustable linear shower drain system 100 is shown in accordance with embodiments of the present disclosure. In some embodiments, the drain interface adapter 104 may comprise flange ends 504A, 504B. Each flange end 504A, 504B may extend from a respective first end 524A and a second end 524B of the drain interface adapter 104 (e.g., in opposite directions) in the X-axis direction of coordinate system 102, and may facilitate the connection between the drain interface adapter 104 and the troughs 108A, 108B. In some embodiments, the flange ends 504A, 504B may extend from the drain interface adapter 104 to provide additional surface area for increased structural support to the other components (e.g., the troughs 108A, 108B, etc.) of the modular adjustable linear shower drain system 100. In one embodiment, the flange ends 504A, 504B may extend 2 inches, 2.5 inches, 3 inches, or more from the body of the drain interface adapter 104. The extension of the flange ends 504A, 504B permit the heights of the drain interface adapter 104 (e.g., the dimension in the Y-axis direction of the coordinate system 102) and the ends of the troughs 108A, 108B and the drainage slope inserts 110A, 110B in contact therewith to remain constant. The remaining ends of the troughs 108A, 108B and the drainage slope inserts 110A, 110B may then be cut to a measured (e.g., desired) length to allow for assembly of a modular adjustable linear shower drain system 100.

In one embodiment, the flange ends 504A, 504B may comprise recessed cutouts 505A, 505B that provide additional support to the troughs 108A, 108B when the troughs 108A, 108B are bonded or adhered to the drain interface adapter 104. Additionally or alternatively, the recessed cutouts 505A, 505B may provide enhanced surface/contact area for any adhesive disposed respectively between the flange ends 504A, 504B and the troughs 108A, 108B (e.g., during the assembly of the modular adjustable linear shower drain system 100).

In one embodiment, the drain interface adapter 104 may additionally comprise one or more (e.g., two) optional threaded inserts 508 disposed on a top surface 506. The optional threaded inserts 508 (e.g., PEM® nut inserts, captured nuts, Heli-Coil® inserts, etc.) may be pressed-in, molded-in, or screwed-in inserts that assist in the connection between the drain interface adapter 104 and the troughs 108A, 108B. In one embodiment, the optional threaded inserts 508 may provide an interface to connect each of the flange ends 504A, 504B of the drain interface adapter 104 with a respective trough 108A, 108B (e.g., via the use of threaded fasteners, etc.). The threaded inserts 508 may be disposed apart on the top surface 506 from one another a distance measured along the X-axis direction of coordinate system 102 and may extend across a portion of or the entirety of the top surface 506 of the drain interface adapter 104 and/or the flange ends 504A, 504B. In one embodiment, the threaded inserts 508 may be evenly spaced along the X-axis.

In some embodiments, the drain interface adapter 104 may comprise a drain interface tube 512 and a drain aperture 520. The drain interface tube 512 may facilitate connection between the drain interface adapter 104 and a drain pipe (e.g., at an installation site). The drain interface tube 512 may have a first end 514, with the first end 514 extending partially into a drain pipe. The first end 514 may be radially designed to interface with the drain pipe. For instance, the radius of the first end 514 may be smaller than the radius of the drain pipe and concentrically align to allow the drain interface adapter 104 to operatively connect to the drain pipe. The drain interface tube 512 may extend from the first end 514 to a second end 515. The second end 515 may connect (e.g., through threaded fasteners, threaded screws, adhesive and/or chemical bonding, etc.) to the drain aperture 520. The connection between the second end 515 and the drain aperture 520 may permit fluid communication from the drain aperture 520 and the drain pipe.

The drain aperture 520 may interface with a portion of the drain pipe, and provide fluidic communication between the drain interface adapter 104 and the drain pipe. For instance, in some embodiments the drain aperture 520 may receive fluid flowing from the drainage slope inserts 110A, 110B and channel the fluid through a hollow portion of the drain interface tube 512 and into the drain pipe. In one embodiment, the flange ends 504A, 504B may be centered on the drain interface tube 512. In other words, the flange ends 504A, 504B may be equidistant from the drain interface tube 512 along the X-axis direction of coordinate system 102

In some embodiments, the drain interface adapter 104 may comprise one or more drainage slope insert receiving cavities 516A, 516B. The drainage slope insert receiving cavities 516A, 516B may receive the drainage slope inserts 110A, 110B when the drainage slope inserts 110A, 110B are connected to the drain interface adapter 104. In some embodiments, the drain interface adapter 104 may comprise a fluid channel 528. The fluid channel 528 may extend across the entirety of the drain interface adapter 104, running from the first end 524A of the drain interface adapter 104 to the second end 524B of the drain interface adapter 104.

In some embodiments, the fluid channel 528 may be separated into a first fluid channel 528A and a second fluid channel 528B by the drain aperture 520 and/or the drain interface tube 512. The fluid channels 528A, 528B may be respectively disposed between the receiving cavities 516A, 516B and the drain interface tube 512 and may respectively allow fluid transfer from the first end 524A and the second end 524B of the drain interface adapter 104 to the drain pipe. In some embodiments, the drainage slope insert receiving cavities 516A, 516B may be formed from recessed cutouts of the fluid channels 528A, 528B.

Figure 6B:
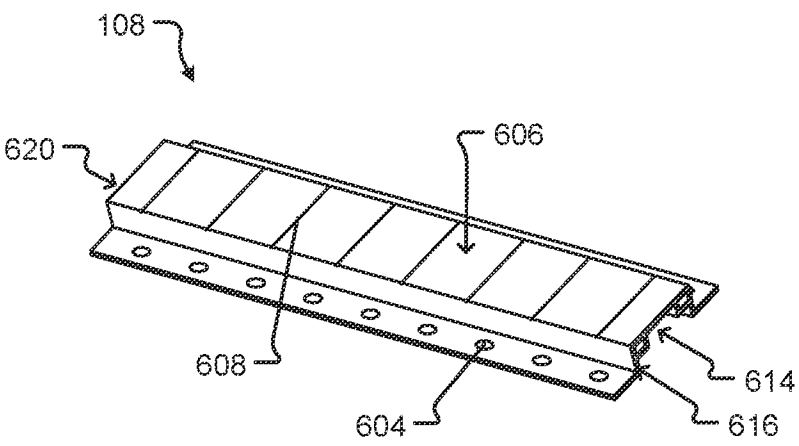
FIG. 6B shows a bottom perspective view of the trough used in the modular adjustable linear shower drain system in accordance with embodiments of the present disclosure.
Figure 6A:
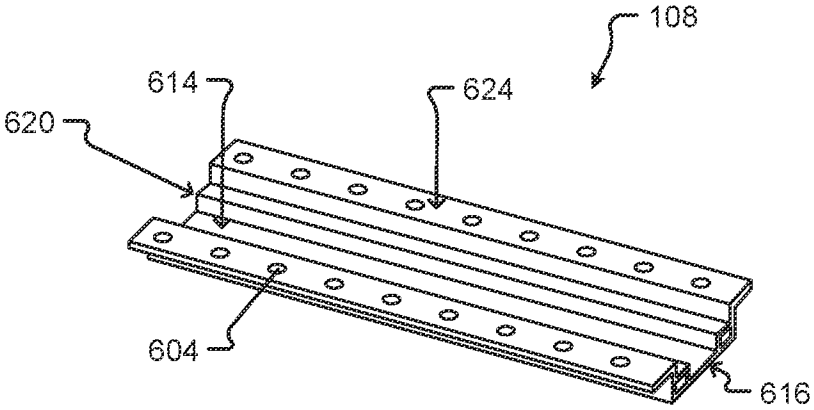
FIG. 6A shows a top perspective view of a trough used in the modular adjustable linear shower drain system in accordance with embodiments of the present disclosure.

As illustrated in FIGS. 6A-6B, a top perspective view and a bottom perspective view, respectively, of a trough 108 used in the modular adjustable linear shower drain system 100 in accordance with embodiments of the present disclosure are shown. In some embodiments, the trough 108 may be similar to or the same as the troughs 108A, 108B. The trough 108 may extend from a first end 616 to a second end 620. The trough 108 may comprise a channel 614 running along a portion of or the entirety of the trough 108 in the X-axis direction of the coordinate system 102. The channel 614 of the trough 108 may align the trough 108 with a drain interface adapter 104. In other words, upon connection of the trough 108 with the drain interface adapter 104, the channel 614 may align with the fluid channel 528; the alignment of the channel 614 with the fluid channel 528 may facilitate fluid communication in the modular adjustable linear shower drain system 100 by reducing the chance of fluid leakage resulting from improper alignment and by channeling fluid to the drain aperture 520.

In some embodiments, the second end 620 may align and interface with the drain interface adapter 104. For instance, during assembly the modular adjustable linear shower drain system 100, the second end 620 may, after measurement at an installation site, be cut to length. The second end 620 may then be operatively connected to one of the flanges 504A, 504B (e.g., by adhesive and/or chemical bonding) and/or the drain interface adapter 104.

In some embodiments, the trough 108 may be created using a method of extrusion. In other words, the trough 108 may be an extruded piece that is extruded to one or more defined (e.g., standard) lengths. The trough 108 may be designed to have a uniform cross-section. The uniform cross-section promotes successful extrusion by allowing, among other things, the trough 108 to cool evenly after extrusion, reducing the possibility of warping while simultaneously reducing material costs.

In some embodiments, the trough 108 may include optional countersunk holes 604 disposed on a top surface 604 that mate-up with the optional threaded inserts 508 once the drain interface adapter 104 and/or the trough 108 are cut to length. While some embodiments contain optional countersunk holes 604, other hole formations are possible. For instance, in some embodiments, the trough 108 may contain other holes (e.g., counterbored holes, through holes, etc.), vias, or the like that enable connection between the drain interface adapter 104 and the troughs 108. The optional countersunk holes 604 may receive the optional threaded inserts 508 such that the surfaces of the drain interface adapter 104 and the trough 108 interconnect. The interconnection may assist with the assembly of the modular adjustable linear shower drain system 100. For instance, the physical interconnection, in combination with the one or more assembly clips 112, may assist with the bonding or adhering of the drain interface adapter 104 and the trough 108 by keeping the drain interface adapter 104 and the trough 108 properly aligned during the bonding or adhering process. In some embodiments, the optional countersunk holes 604 may be evenly spaced and extend along a portion of or the entirety of the trough 108 in the X-axis direction of the coordinate system 102. The optional countersunk holes 604 may be formed during the molding of the trough 108 (e.g., by providing posts in the mold around which material forms, leaving the optional countersunk holes), or may alternatively be created after the extrusion of the trough 108 (e.g., by drilling through the trough 108 to form the optional countersunk holes).

In some embodiments, the trough 108 may include optional machined (e.g., v-shaped, u-shaped, etc.) or otherwise formed grooves 608 on the bottom underside surface 606 that act as a guide for installers cutting the trough 108 to length. The optional grooves 608 may be spaced apart at various distances (e.g., ¼ inch, ½ inch, % inch, 1 inch, 5 cm, 10 cm, or more) along the X-axis direction of the coordinate system 102. The optional grooves 608 may extend partially or completely along the trough 108 in the Z-axis direction. In some embodiments, the optional grooves 608 may be created when the trough 108 is molded (e.g., the mold used to create the trough 108 may contain grooves to create the optional grooves 608) or may be created after extrusion of the trough 108 (e.g., by cutting away or removing material from the trough 108 to form the optional grooves 608).

In some embodiments, the channel 614 may assist the adhering or bonding of one of the drainage slope inserts 110A, 110B to the trough 108. For instance, the width of the channel 614 (e.g., the dimension of the channel 614 in the Z-axis direction of the coordinate system 102) may provide clearance for one of the drainage slope inserts 110A, 110B to be more easily inserted into the trough 108.

Figure 7A:
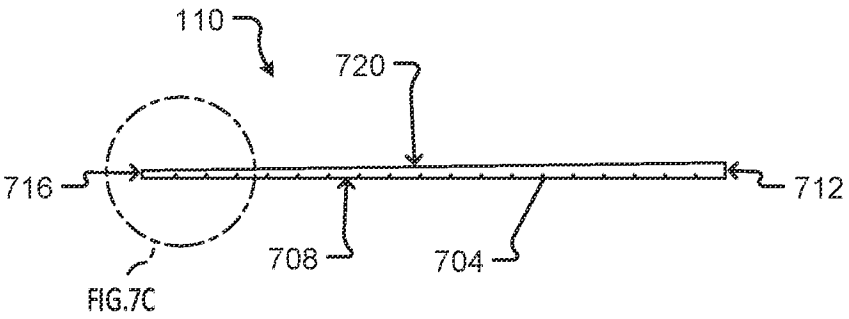
FIG. 7A shows an elevation view of a drainage slope insert used in the modular adjustable linear shower drain system in accordance with embodiments of the present disclosure.
Figure 7B:
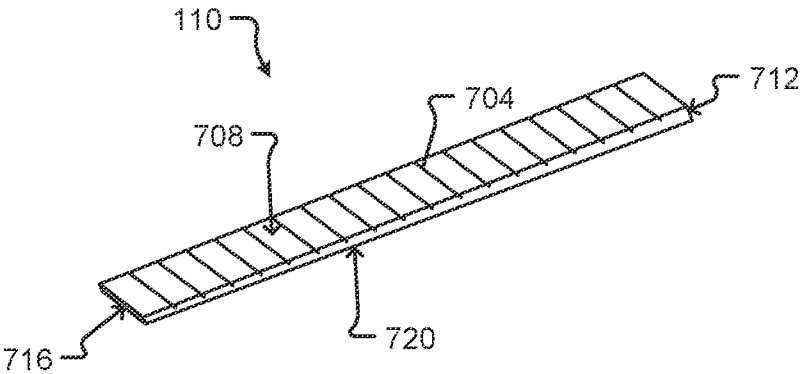
FIG. 7B shows a bottom perspective view of the drainage slope insert used in the modular adjustable linear shower drain system in accordance with embodiments of the present disclosure.

FIG. 7A shows an elevation view of a drainage slope insert 110 used in the modular adjustable linear shower drain system 100 in accordance with embodiments of the present disclosure, and FIG. 7B shows a bottom perspective view of the drainage slope insert 110 used in the modular adjustable linear shower drain system 100 in accordance with embodiments of the present disclosure. In some embodiments, the drainage slope insert 110 may correspond to the first drainage slope insert 110A, 110B. The drainage slope insert 110 runs a length from a first end 712 to a second end 716. In some embodiments, the length may be sized to fit a particular standard configuration 300, 400. As shown at least in FIG. 7A, the drainage slope insert 110 may gradually taper from the first end 712 to the second end 716, or vice versa. Stated another way, the dimension or height of the drainage slope insert 110 measured at the first end 712 (e.g., along the Y-axis) may be greater than the dimension or height of the drainage slope insert 110 measured at the second end 716 (e.g., along the Y-axis). This taper may provide a tapered surface 720 that is linear, curvilinear, and/or combinations thereof along the length and cross-section of the drainage slope insert 110. In some embodiments, the tapered surface 720 may be a smooth, or uninterrupted, surface running along the length of the drainage slope insert 110. Among other things, this tapered surface 720 may provide at least one inclined surface that conveys fluid (e.g., water, etc.) from an area outside of, or away from, the drain interface adapter 104 in a direction toward the drain interface adapter 104. More specifically, the tapered surface 720 may guide fluid along the fluid channel 528 of the modular adjustable linear shower drain system 100 toward the drain aperture 520.

In some embodiments, the drainage slope inserts 110A, 110B may include machined (e.g., v-shaped, u-shaped, etc.) or otherwise formed grooves 704 disposed on the bottom underside surface 708. In some embodiments, the grooves 704 may serve as a guide (e.g., ensuring straight cuts, lengths, etc.) for installers when cutting the drainage slope inserts 110A, 110B to length on-site. The grooves 704 may additionally provide enhanced surface/contact area for any adhesive disposed between the surface and the troughs 108A, 108B (e.g., during the assembly of the modular adjustable linear shower drain system 100). The grooves 704 may be spaced apart at various distances (e.g., ¼ inch, ½ inch, % inch, 1 inch, 5 cm, 10 cm, or more) along the X-axis direction of the coordinate system 102. The grooves 704 may extend partially or completely along the drainage slope inserts 110A, 110B in the Z-axis direction. In some embodiments, the grooves 704 may be spaced apart by the same distance as the optional countersunk holes 604 of the troughs 108A, 108B, and the grooves 704 may be offset from the optional countersunk holes 604 by half the distance therebetween. In other words, each of the grooves 704 may be centered between two of the optional countersunk holes 604 along the X-axis direction of the coordinate system 102.

In some embodiments, the grooves 704 may be created when the drainage slope inserts 110A, 110B are molded (e.g., the mold used to create the drainage slope inserts 110A, 110B may contain grooves to create the grooves) or may be created after extrusion of the drainage slope inserts 110A, 110B (e.g., by cutting away or removing material from the drainage slope inserts 110A, 110B to form the grooves).

Figure 7C:
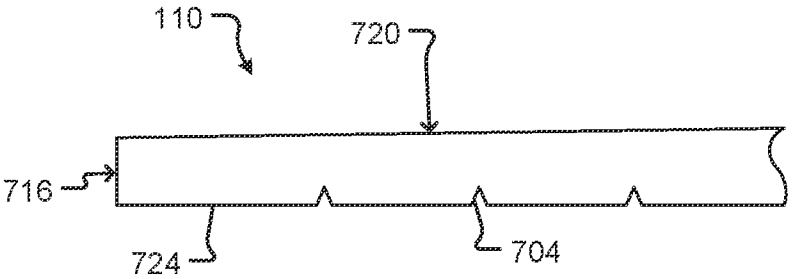
FIG. 7C shows a detailed view of a second end of the drainage slope insert containing a buffer zone used in the modular adjustable linear shower drain system in accordance with embodiments of the present disclosure.

As shown in FIG. 7C, in some embodiments the grooves 704 of the drainage slope insert 110 may only extend partially along the X-axis direction of the coordinate system 102 from the first end 712 to the second end 716. For instance, the grooves 704 may end before the second end 716, creating a buffer zone 724. The buffer zone 724 may indicate a boundary (e.g., a recommended limit) to which the drainage slope inserts 110A, 110B should be cut. In other words, the buffer zone 724 may be designed to indicate that further cuts past the buffer zone toward the second end 716 should be avoided. In some embodiments, the buffer zone 724 may be made of material intended to discourage further cuts in the drainage slope inserts 110A, 110B toward the second end 716 (or toward the drain interface adapter 104). The buffer zone 724 may begin at the second end 716 and may extend toward the first end 712. In some embodiments, the buffer zone 724 may extend to the first end 524A and/or to the second end 524B of the drain interface adapter 104. In such embodiments, the buffer zone 724 may indicate that portions of the drainage slope inserts 110A, 110B within (e.g., contacting) the drain interface adapter 104 should be avoided when cutting the drainage slope inserts 110A, 110B to a measured (e.g., desired) length.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A shower drain system, comprising:

a drain interface adapter configured to interface with a drain pipe at an installation site;

a linear trough interconnected to the drain interface adapter at one end of the drain interface adapter;

a drainage slope insert configured to be disposed in a channel of the trough, wherein the drainage slope insert slopes from a first dimension to a shorter second dimension at the drain interface adapter; and a grill comprising a plurality of screws configured to rotate and, in response to rotation, adjust an install height of the grill within the linear trough.

2. The shower drain system of claim 1, wherein the grill is nested in a receiving portion of the drain interface adapter and the linear trough.

3. The shower drain system of claim 2, wherein the grill is adjustable in height relative to the drain interface adapter and the trough via rotation of the plurality of screws and wherein an overall length of the shower drain system is adjustable by cutting a portion of material from the linear trough, the drainage slope insert, and the grill prior to assembly.

4. The shower drain system of claim 1, wherein the linear trough comprises a first surface contacting at least one groove and wherein the first surface of the linear trough contacts the drain interface adapter.

5. The shower drain system of claim 1, wherein the drainage slope insert comprises a first surface contacting at least one groove and wherein the first surface of the drainage slope insert contacts the linear trough.

6. The shower drain system of claim 1, wherein the drain interface adapter comprises at least one threaded insert disposed on a first surface thereof.

7. The shower drain system of claim 1, wherein the linear trough comprises one or more portions.

8. The shower drain system of claim 1, wherein the drain interface adapter comprises a polytetrafluoroethylene (PTFE) coating.

9. The shower drain system of claim 1, wherein the linear trough comprises a first trough and a second trough.

10. The shower drain system of claim 9, wherein the first trough comprises a channel running along a length of the first trough from an open end of the first trough to a closed end of the first trough, wherein the first trough is interconnected to the drain interface adapter at a first recessed cutout disposed on the one end of a flange, and wherein a length of the first trough is adjustable by cutting a portion of material from the open end of the first trough.

11. The shower drain system of claim 10, wherein the second trough comprises a channel running along a length of the second trough from an open end of the second trough to a closed end of the second trough, wherein the second trough is interconnected to the drain interface adapter at the first recessed cutout disposed on an opposite end of the flange, and wherein a length of the second trough is adjustable by cutting a portion of material from the open end of the second trough.

12. The shower drain system of claim 1, wherein the linear trough comprises one or more channels having at least one open end.

13. The shower drain system of claim 1, wherein the linear trough comprises a channel running along a length of the linear trough from an open end of the linear trough to a closed end of the linear trough, wherein the linear trough is interconnected to the drain interface adapter at a first recessed cutout disposed on the one end of a flange, and wherein a length of the linear trough is adjustable by cutting a portion of material from the open end of the linear trough.

14. The shower drain system of claim 1, wherein the drain interface adapter comprises:

a drain tube disposed in a center of the drain interface adapter, the drain tube comprising a hollow portion running from a first end to a second end of the drain tube;

a flange disposed perpendicular to the drain tube; and a fluid channel running from one end of the flange to an opposite end of the flange across the drain tube.

15. The shower drain system of claim 14, wherein the flange is substantially rectangular, wherein the flange is attached to the drain tube at the first end, and wherein the flange is centered on the drain tube.

16. The shower drain system of claim 14, wherein the drain interface adapter further comprises:

one or more recessed cutouts disposed on one end of the flange.

17. The shower drain system of claim 14, wherein the drain interface adapter further comprises:

one or more recessed cutouts disposed in the fluid channel at the opposite end of the flange.

18. The shower drain system of claim 1, wherein the drainage slope insert comprises a single drainage slope insert.

19. The shower drain system of claim 1, wherein the drainage slope insert comprises multiple drainage slope inserts.

20. The shower drain system of claim 1, wherein the linear trough comprises at least one surface containing at least one groove.

* * * * *